US010177482B2

(12) United States Patent
Takamura

(10) Patent No.: US 10,177,482 B2
(45) Date of Patent: Jan. 8, 2019

(54) CONNECTOR TO PREVENT A MALE TERMINAL FROM BEING DAMAGED DUE TO IMPROPER COUPLING WITH A COUNTERPART CONNECTOR

(71) Applicant: Yazaki Corporation, Minato-ku, Tokyo (JP)

(72) Inventor: Naoki Takamura, Makinohara (JP)

(73) Assignee: Yazaki Corporation, Minato-ku, Tokyo (JP)

( * ) Notice: Subject to any disclaimer, the term of this patent is extended or adjusted under 35 U.S.C. 154(b) by 0 days.

(21) Appl. No.: 16/000,998

(22) Filed: Jun. 6, 2018

(65) Prior Publication Data

US 2018/0351281 A1 Dec. 6, 2018

(30) Foreign Application Priority Data

Jun. 6, 2017 (JP) ..... 2017-111769

(51) Int. Cl.

| | |
|---|---|
| ***H01R 13/436*** | (2006.01) |
| ***H01R 13/641*** | (2006.01) |
| ***H01R 13/11*** | (2006.01) |
| ***H01R 13/629*** | (2006.01) |
| ***H01R 13/422*** | (2006.01) |

(52) U.S. Cl.

CPC ..... *H01R 13/4368* (2013.01); *H01R 13/113* (2013.01); *H01R 13/4223* (2013.01); *H01R 13/629* (2013.01); *H01R 13/641* (2013.01)

(58) Field of Classification Search

CPC ..... H01R 13/4368; H01R 13/113; H01R 13/629; H01R 13/641; H01R 13/4223; H01R 13/4226; H01R 13/64; H01R 13/642

USPC .... 439/752, 595, 733.1, 744, 660, 677, 678, 439/679, 680

See application file for complete search history.

(56) References Cited

U.S. PATENT DOCUMENTS 5,749,747 A * 5/1998 Inaba ..... H01R 13/641 439/352
6,102,726 A * 8/2000 Tsuji ..... H01R 13/6272 439/352

(Continued)

FOREIGN PATENT DOCUMENTS

JP 2009-181717 A 8/2009

*Primary Examiner* — Tulsidas C Patel
*Assistant Examiner* — Travis Chambers
(74) *Attorney, Agent, or Firm* — Banner & Witcoff, Ltd.

(57) ABSTRACT

In a connector, a connector housing includes a terminal accommodating chamber in which a female terminal is to be accommodated, an elastic locking piece configured to lock the female terminal accommodated in the terminal accommodating chamber, and a wall surface. A male terminal insertion hole and a male terminal release hole are formed in the wall surface. A male terminal of a counterpart connector is to be inserted into the male terminal insertion hole so as to be connected to the female terminal, when a fitting operation between the connector and the counterpart connector is performed in a regular fitting posture. The male terminal is to enter the male terminal release hole, when the fitting operation is performed in an irregular fitting posture. The male terminal release hole forms a space which is continuous from the wall surface to the elastic locking piece.

2 Claims, 9 Drawing Sheets

(56) References Cited

U.S. PATENT DOCUMENTS 6,758,700 B2 * 7/2004 Konno ..... H01R 13/631
439/595
8,052,489 B2 * 11/2011 Mase ..... H01R 13/4223
439/595

* cited by examiner

CONNECTOR TO PREVENT A MALE TERMINAL FROM BEING DAMAGED DUE TO IMPROPER COUPLING WITH A COUNTERPART CONNECTOR

CROSS-REFERENCES TO RELATED APPLICATIONS

This application is based on and claims priority from Japanese Patent Applications No. 2017-111769 filed on Jun. 6, 2017, the entire contents of which are incorporated herein by reference.

BACKGROUND

1. Field of the Invention

The present invention relates to a connector in which a female terminal is locked by an elastic locking piece in a terminal accommodating chamber provided in a connector housing.

2. Description of Related Art

In related art, a connector provided with a female terminal and a counterpart connector provided with a male terminal are adapted to be prevented from being fitted with each other in an irregular posture by providing a fitting rib on the counterpart connector for regulating fitting in the irregular posture.

For example, JP-A-2009-181717 discloses a connector provided with a damage prevention part which restricts further fitting operation by interfering with a fitting rib of a connector housing of a counterpart connector, when the fitting posture of the connector housing is inclined to be changed from a regular posture to an irregular posture at the time of fitting into the counterpart connector.

However, in the connector of JP-A-2009-181717, since it is necessary to provide the damage prevention part in the connector housing, a size of the connector becomes increased.

In addition, as a result of recent demand for miniaturization of connectors, when strength of a connector is insufficient, even if a fitting rib is provided in a counterpart connector provided with the male terminal, a fitting operation may be performed with excessive force and in an irregular posture. As a result, there is a risk that the male terminal may be damaged by hitting the wall of the connector.

SUMMARY

In accordance with embodiments, a connector would prevent a male terminal of a counterpart connector from being damaged, even when a fitting operation is performed in an irregular fitting posture due to excessive force, while achieving miniaturization.

In a connector, a connector housing includes a terminal accommodating chamber in which a female terminal is to be accommodated, an elastic locking piece configured to lock the female terminal accommodated in the terminal accommodating chamber, and a wall surface. A male terminal insertion hole and a male terminal release hole are formed in the wall surface. A male terminal of a counterpart connector is to be inserted into the male terminal insertion hole so as to be connected to the female terminal, when a fitting operation between the connector and the counterpart connector is performed in a regular fitting posture. The male terminal is to enter the male terminal release hole, when the fitting operation is performed in an irregular fitting posture. The male terminal release hole forms a space which is continuous from the wall surface to the elastic locking piece.

Other aspects and advantages of the invention will be apparent from the following description and the appended claims.

DETAILED DESCRIPTION

A connector according to an exemplary embodiment will be described in detail below with reference to the drawings.

Figure 1:
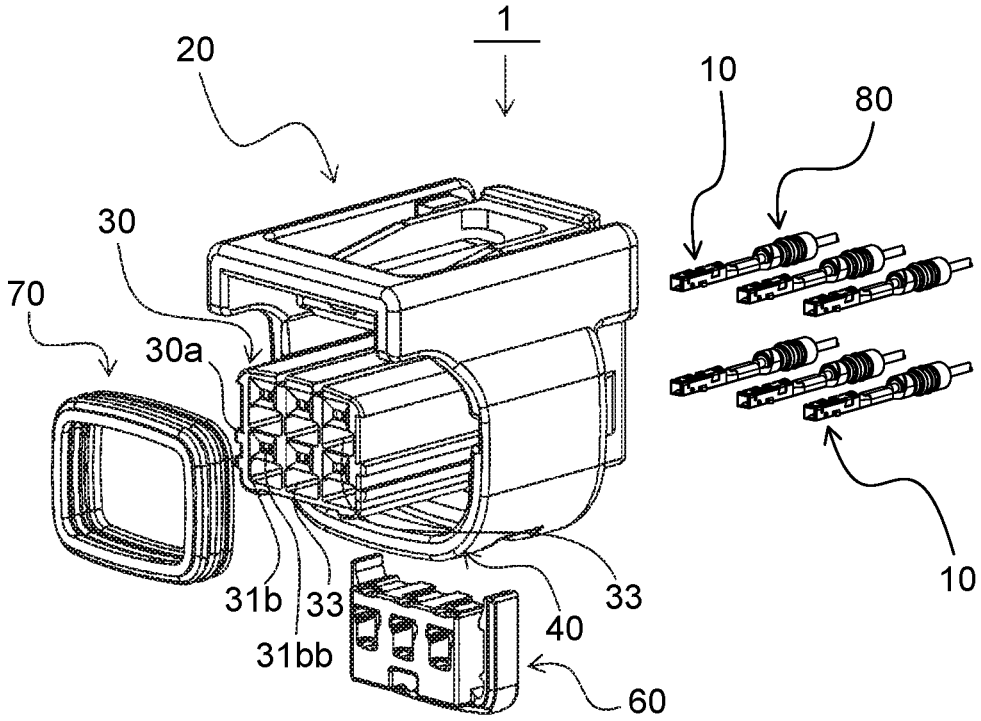
FIG. 1 is an exploded perspective view of a connector according to an embodiment.
Figure 2A:
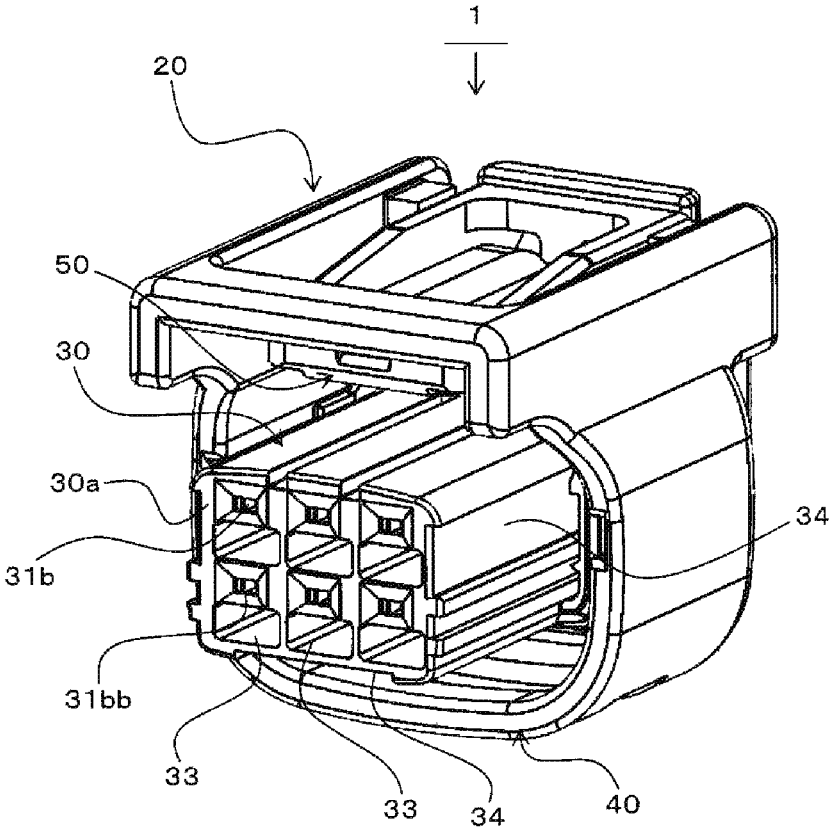
FIG. 2A is a perspective view of the connector.
Figure 2B:
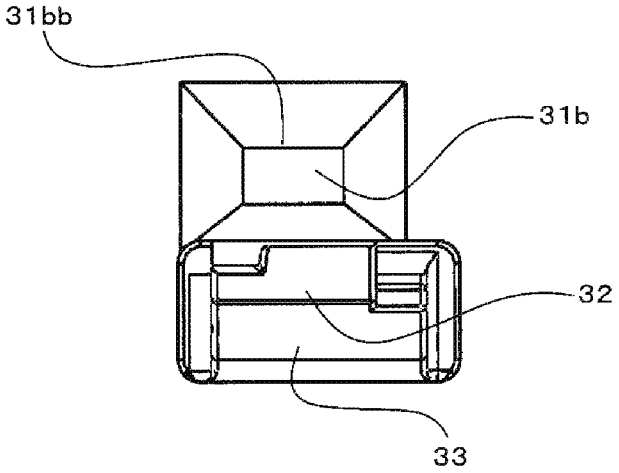
FIG. 2B is an enlarged view of the periphery of a male terminal release hole.
Figure 3:
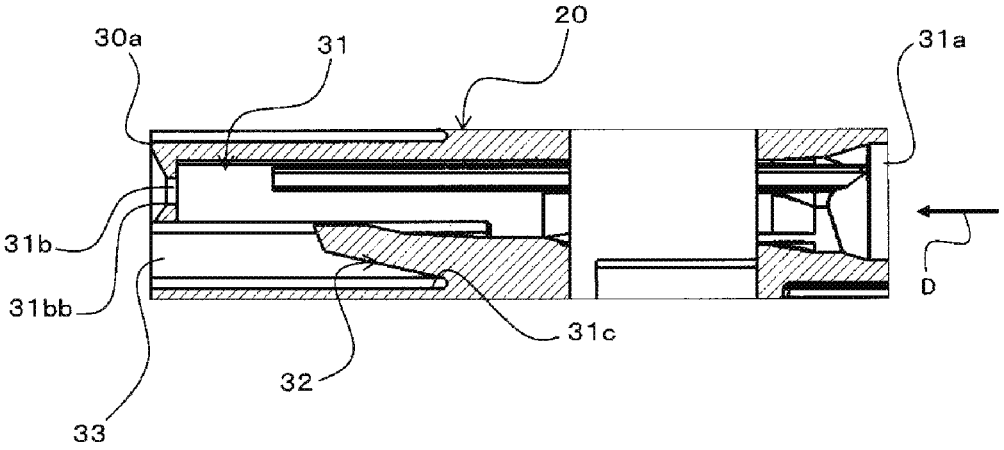
FIG. 3 is a cross-sectional view of a terminal accommodating chamber.
Figure 4A:
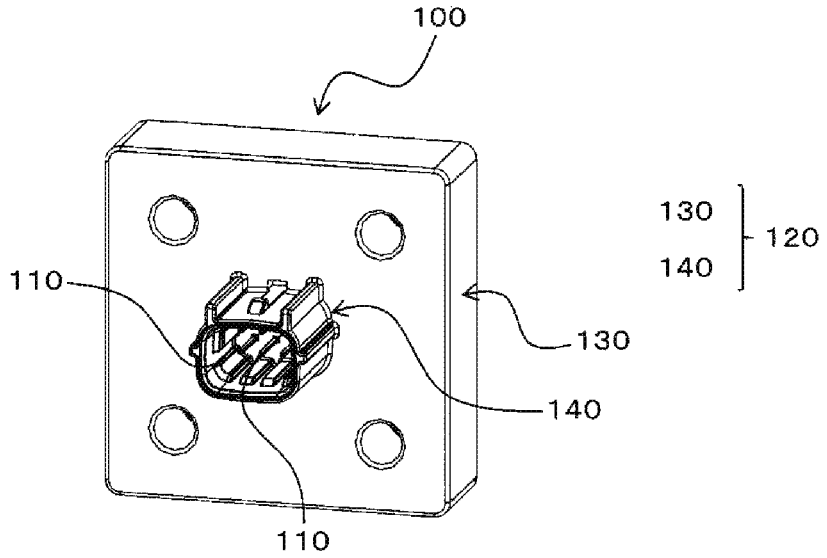
FIG. 4A is a perspective view of a counterpart connector.
Figure 4B:
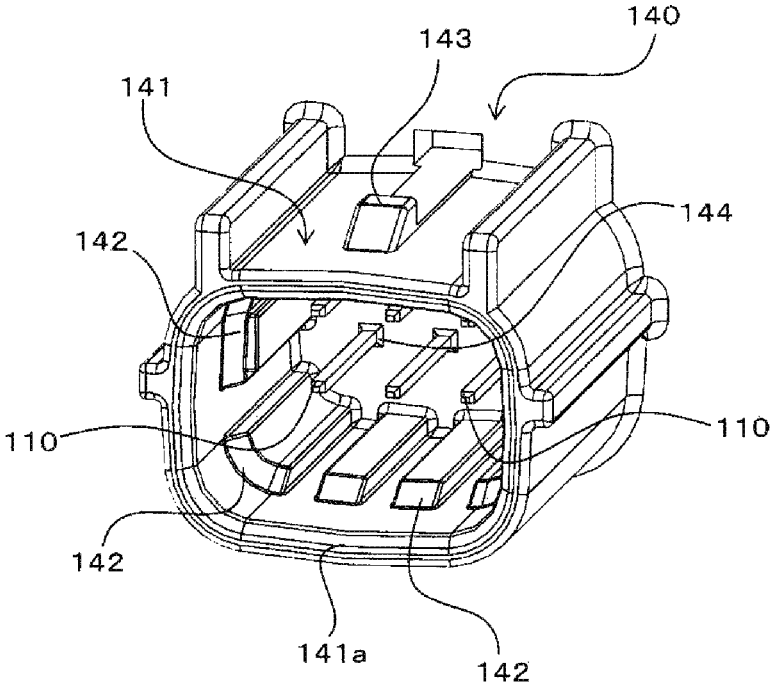
FIG. 4B is an enlarged view of the periphery of a fitting part of the counterpart connector illustrated in FIG. 4A.
Figure 5:
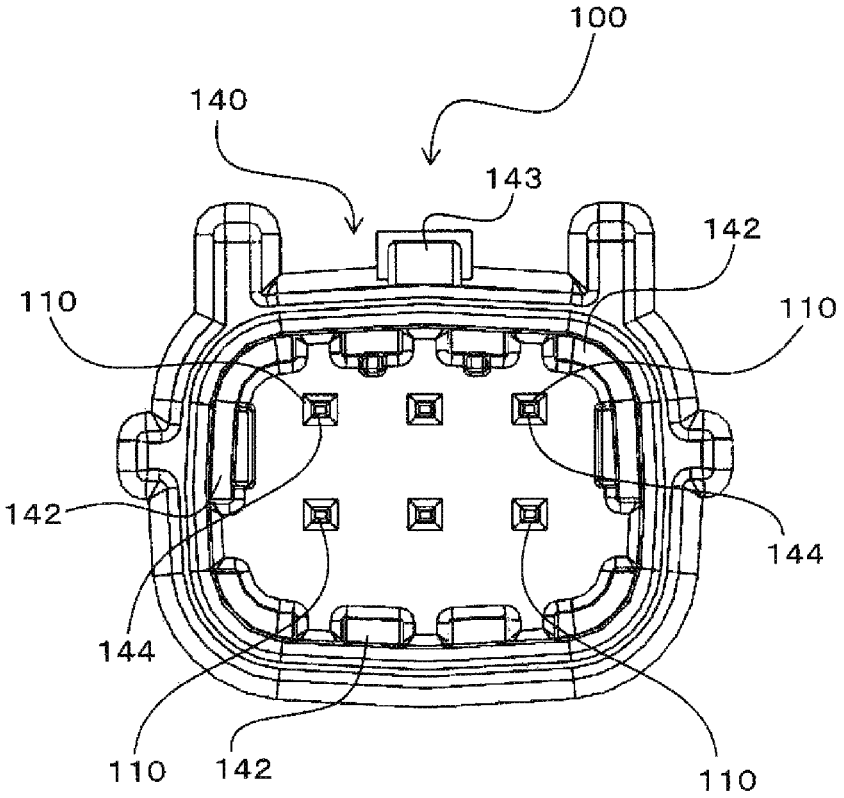
FIG. 5 is a view of the fitting part as viewed from a side of a fitting opening.
Figure 6:
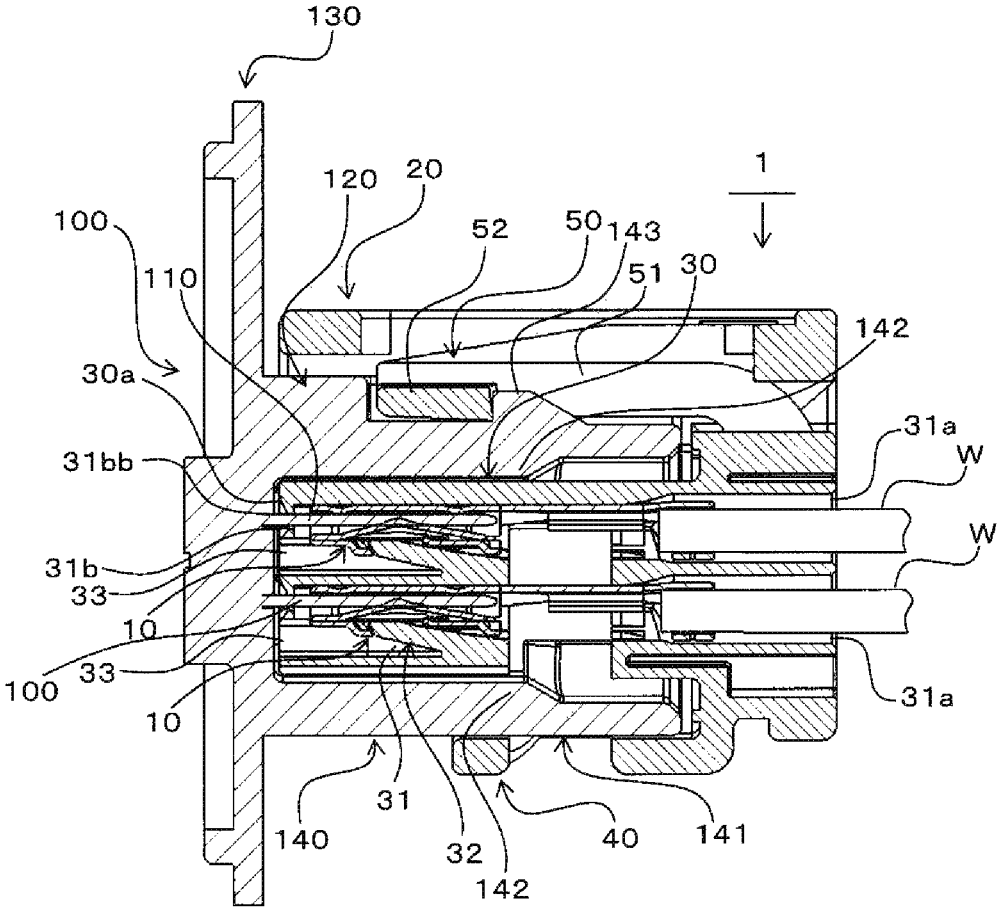
FIG. 6 is a cross-sectional view illustrating a state where the connector and the counterpart connector are completely fitted to each other in a regular fitting posture.
Figure 7:
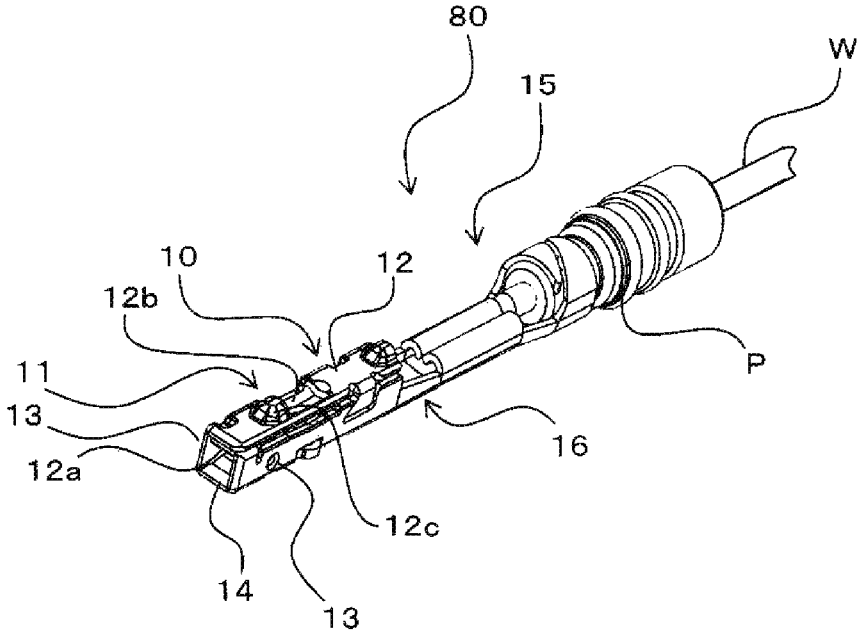
FIG. 7 is a perspective view of an electric wire with a terminal.

FIG. 1 is an exploded perspective view of a connector 1 excluding a male terminal 10 according to an embodiment. FIG. 2A is a perspective view of the connector 1, and FIG. 2B is an enlarged view of the periphery of a male terminal release hole 33. FIG. 3 is a cross-sectional view of a terminal accommodating chamber 31. FIG. 4A is a perspective view of a counterpart connector 100 and FIG. 4B is an enlarged view of the periphery of a fitting part 140 of the counterpart connector 100 illustrated in FIG. 4A. FIG. 5 is a view of the fitting part 140 as seen from a side of a fitting opening. FIG. 6 is a cross-sectional view illustrating a state where the connector 1 and the counterpart connector 100 are completely fitted in a regular fitting posture. FIG. 7 is a perspective view of an electric wire 80 with terminals.

Figure 8A:
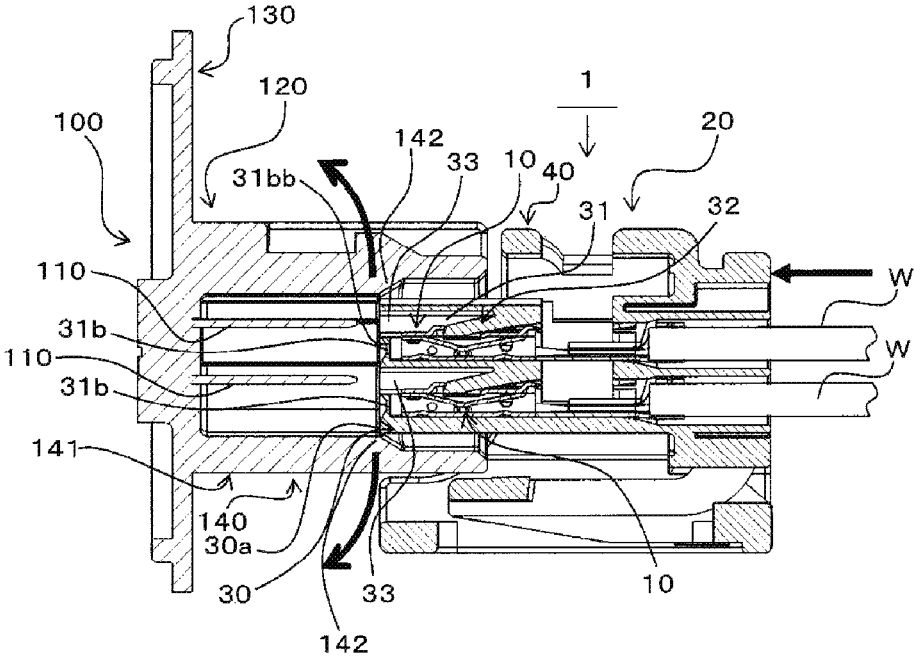
FIG. 8A is a view illustrating a state where a terminal accommodating part of the connector hits against a fitting rib of the counterpart connector.
Figure 8B:
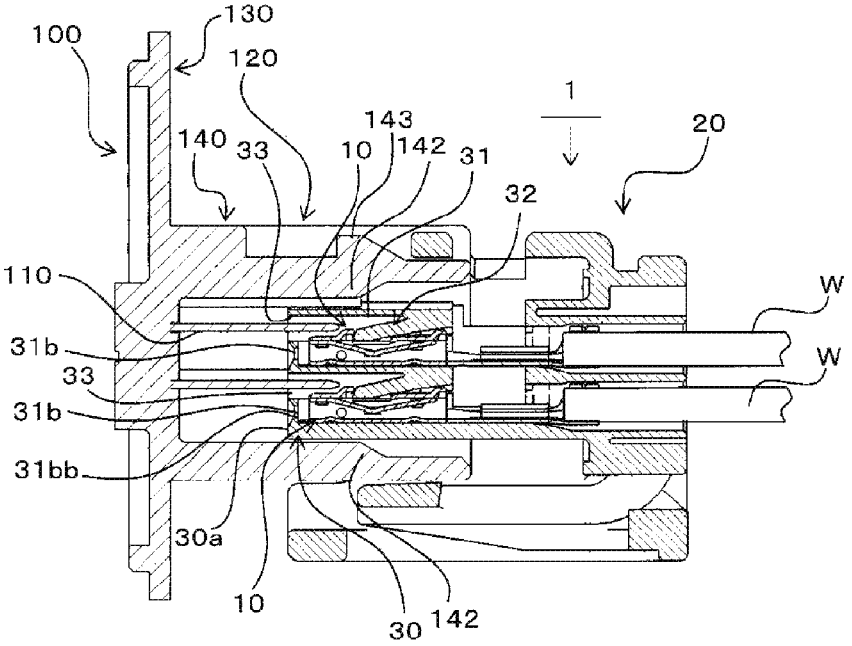
FIG. 8B is a view illustrating a state where the fitting of the connector and the counterpart connector with each other reaches a position deeper than the detecting position by the fitting rib.

Further, FIGS. 6 and 8A and 8B are views in which a spacer 60 is detached.

The connector 1 according to the embodiment of the invention is, for example, used for an electrical connection of an in-vehicle camera.

The connector 1 includes a connector housing 20 provided with a plurality of terminal accommodating chambers 31 in which a plurality of female terminals 10 are accommodated, the female terminals 10 accommodated in the terminal accommodating chambers 31, a spacer 60 which locks the female terminals 10 accommodated in the terminal accommodating chambers 31, and a seal ring 70 which seals a fitting part between the connector and the counterpart connector 100 to which the connector 1 is connected in a state where the counterpart connector 100 is fitted in a waterproof manner.

Although an example in which the six female terminals 10 are accommodated in each of the six terminal accommodating chambers 31 is illustrated in this embodiment, the number of the female terminals 10 and the terminal accommodating chambers 31 provided to correspond to the number of the female terminals 10 is not limited to six but may be one or more.

First, the female terminal 10 will be described.

As illustrated in FIG. 7, the female terminal 10 is attached to a terminal part of the electric wire W together with a rubber stopper P for waterproof.

That is, the female terminal 10 constitutes a part of the electric wire 80 with terminals by being attached to the terminal part of the electric wire W.

The female terminal 10 includes a counterpart terminal connecting part 11 which is a part to be connected with the male terminal 110, an electric wire connecting part 15 which is a part connected to the electric wire W, and a coupling part 16 which couples the counterpart terminal connecting part 11 and the electric wire connecting part 15.

The counterpart terminal connecting part 11 includes a bottom wall 12, a pair of side walls 13 and 13, and a ceiling wall 14, and has a quadrangular cylindrical shape in which adjacent walls are bent at substantially right angles.

The counterpart terminal connecting part 11 is connected to the male terminal 110 by inserting the male terminal 110 into the cylinder.

Figure 9:
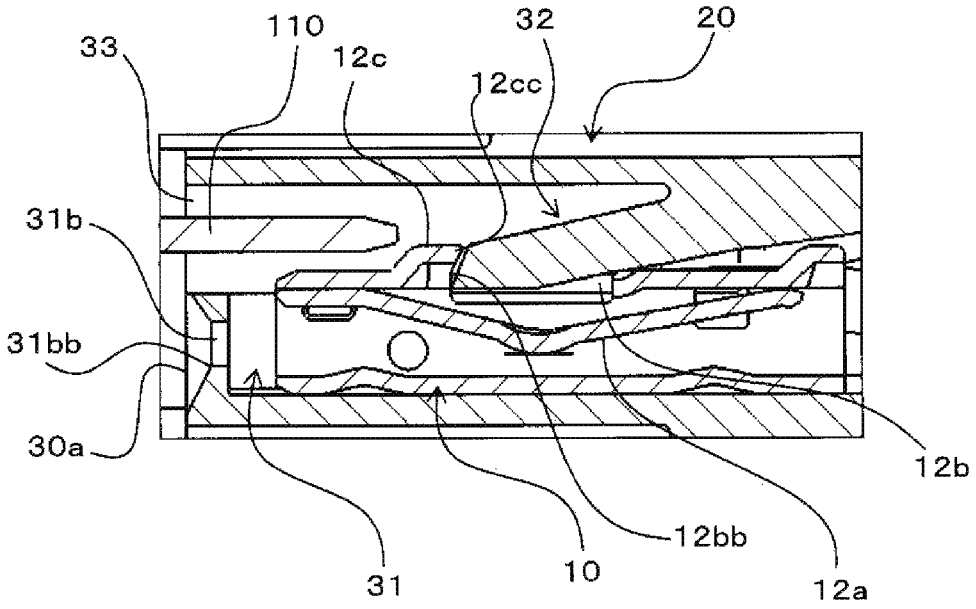
FIG. 9 is an enlarged view of the periphery of the male terminal release hole of FIG. 8B.

As illustrated in FIG. 9, on the inner surface of the bottom wall 12, an elastic contact piece 12*a* which is a part connected to the male terminal 110 is provided. On the outer surface of the bottom wall 12, a notched part 12*b* into which the periphery of the front end portion of the elastic locking piece 32 provided in the terminal accommodating chamber 31 enters, and a locking protrusion 12*c* in which rear end surface 12*cc* continued to the front inner edge surface 12*bb* of the notched part 12*b*.

When the female terminal 10 is moved to the side of the terminal insertion port 31*a*, the periphery of the front end portion of the elastic locking piece 32 which has entered the notched part 12*b* comes into contact with the rear end surface 12*cc* and the inner edge surface 12*bb*. The surface of the elastic locking piece 32 that is in contact with the periphery of the front end portion is enlarged by the locking protrusion 12*c*.

Next, the connector housing 20 will be described.

The connector housing 20 is made of an insulating synthetic resin material. As illustrated in FIGS. 1 to 3, the connector housing 20 includes a rectangular block-shaped terminal accommodating part 30 provided with the six terminal accommodating chambers 31, a hood part 40 which covers the terminal receiving portion 30 and the counterpart connector 100 with an interval of the fitting side end portion, and a fitting lock arm 50 which locks a fitting completion state with the counterpart connector 100.

In the terminal accommodating part 30, six terminal accommodating chambers 31 are arranged therein side by side in two rows and three columns, and guide grooves 34 corresponding to fitting ribs 142 of the counterpart connector 100, which will be described later, are formed on the outer peripheral surface.

As illustrated in FIG. 3, the terminal accommodating chamber 31 forms a space which penetrates from the terminal insertion port 31*a*, into which the female terminal 10 is inserted, to the male terminal insertion hole 31*b* into which the male terminal 110 is inserted.

In the terminal accommodating chamber 31, an inner wall surface shape in a direction orthogonal to an insertion direction D of the female terminal 10 has a rectangular shape to correspond to the cross-sectional shape of the female terminal 10, and the elastic locking 32 extends from the inner wall surface 31*c* on the lower surface side of FIG. 3.

The elastic locking piece 32 includes a fixed end provided on the inner wall surface 31*c* on the lower surface side of the terminal accommodating chamber 31, and the elastic locking piece 32 is provided to protrude from the inner wall surface of the terminal accommodating chamber 31 such that the free end for locking the female terminal 10 elastically returns to a neutral position in a state where the front end thereof is directed obliquely forward.

Further, the terminal accommodating part 30 is provided with a male terminal release hole 33 through which the male terminal 110 releases when the connector 1 is fitted into the counterpart connector 100 in the irregular fitting posture.

As the male terminal release hole 33, the molding through hole of the elastic locking piece 32 for locking the female terminal 10 inside the terminal accommodating chamber 31 is provided as a hole, through which the male terminal 110 releases, at a position where the male terminal 110 enters and releases when the connector is subjected to the fitting operation with respect to the counterpart connector 100 in the irregular fitting posture, on the wall surface 30*a* formed with an inlet opening 31*bb* of the male terminal insertion hole 31*b* in which the male terminal 110 of the counterpart connector 100 is inserted to be connected to the female terminal 10 accommodated in the terminal accommodating chamber 31 when the fitting operation is performed in the regular fitting posture.

As illustrated in FIGS. 2A and 2B, the male terminal release hole 33 is provided below the inlet opening 31*bb* side by side on the wall surface 30*a* in which the inlet opening 31*bb* of the male terminal insertion hole 31*b* of the terminal accommodating part 30 is formed.

That is, on the wall surface 30*a* of the terminal accommodating part 30, to correspond to the terminal accommodating chamber 31 in which the six male terminal release holes 33 are arranged in two rows and three columns, the inlet openings 31*bb* of each male terminal insertion hole 31*b* are arranged on the lower side in two rows and three columns.

Further, as illustrated in FIG. 3, the male terminal release hole 33 forms a continuous space from the wall surface 30*a* in which the inlet opening 31*bb* of the male terminal insertion hole 31*b* is formed to the elastic locking piece 32.

In a hood part 40, since a cylindrical main body portion 141 to be described later of the counterpart connector 100 is inserted and disposed in the gap with the outer peripheral surface of the fitting side end portion of the terminal accommodating part 30 in a completely fitted with the counterpart connector 100, walls are arranged along the outer peripheral surface of the cylindrical main body portion 141.

As illustrated in FIG. 6, the fitting lock arm 50 includes a pair of arm portions 51 and 51 in which a fixed end is erected on the outer surface of the end portion on the side of the terminal insertion port 31*a* of the terminal accommodating part 30 and a free end extends in a fitting direction in the shape of arm, and a locking coupling part 52 which couples the front end portions of the pair of arm portions 51 and 51 to be bridged and serves as a portion to be caught by a lock protrusion 143 of the connector 1 to be described later.

The spacer 60 is configured as a separate component from the connector housing 20 and is mounted through an opening communicating with the terminal accommodating chamber 31 provided in the connector housing 20 so that each female terminal 10 accommodated in the terminal accommodating chamber 31 is locked.

That is, the spacer 60 has a double locking function of locking the female terminal 10 together with the elastic locking piece 32 provided in the terminal accommodating chamber 31. Further, FIGS. 6 and 8A and 8B are views in which the spacer 60 is detached.

The seal ring 70 is made of an annular elastic material such as rubber, and is fixed to a base end position of the terminal accommodating part 30.

The counterpart connector 100 will now be described.

The counterpart connector 100 includes a counterpart connector housing 120, and six male terminals 110 connected to the six female terminals 10.

As illustrated in FIGS. 4A and 4B, the counterpart connector housing 120 includes a cover part 130 made of an insulating synthetic resin material and constituting a part of an accommodation part of a camera component, and a fitting part 140 which is a part fitted with the connector housing 20.

The fitting part 140 includes a bottomed cylindrical main body portion 141 disposed so as to surround the fitting side end portion outer peripheral surface of the terminal accommodating part 30 in in the state of being completely fitted with the connector 1, a fitting rib 142 for detecting that it is not fitted in the regular posture, a locking protrusion 143 locked with the fitting locking arm 50 for locking the fitting completion state of the connector 1, and a male terminal holding part 144 which holds the male terminal sixth male terminal 110.

The fitting rib 142 is a rib extending from a position, which is lowered inward by a prescribed width from the opening end edge surface 141*a* of the cylindrical main body portion 141, to the bottom surface of the cylindrical main body portion 141 along the fitting direction, and the fitting ribs 142 are provided at a plurality of positions on the cylinder inner peripheral surface of the cylindrical main body portion 141.

Further, the fitting rib 142 is provided such that the end portion thereof is positioned closer to the opening of the cylindrical main body portion than the front end of the male terminal 110.

The locking protrusion 143 is a part which protrudes from the outer surface of the cylindrical main body portion 141 and with which the locking coupling part 52 of the fitting lock arm 50 of the connector 1 is caught and locked.

The male terminal holding part 144 is a through hole which is formed so that the male terminal 110 is press-fitted into the wall which forms the bottom surface of the fitting part 140.

As illustrated in FIG. 5, the male terminal holding parts 144 are arranged in two rows and three columns to correspond to the six female terminals 10 accommodated in the terminal accommodating part 30 of the connector 1.

Here, the procedure for completing the fitting by performing the fitting operation with the connector 1 and the counterpart connector 100 in the regular fitting posture and the operation of each part will be described.

First, the fitting side end portion of the terminal accommodating part 30 of the connector 1 starts to be fitted into the cylindrical main body portion 141 from the opening of the cylindrical main body portion 141 of the counterpart connector 100.

Then, the respective guide grooves 34 formed on the outer periphery of the terminal accommodating part 30 are fitted into the corresponding fitting ribs 142, and connector 1 is moved in the fitting direction up to the fitting completion position with the counterpart connector 100, while keeping the fitting between the guide groove 34 and the fitting rib 142.

At this time, each male terminal 110 of the counterpart connector 100 is inserted into the terminal accommodating chamber 31 through the male terminal insertion hole 31*b* of the terminal accommodating chamber 31 in which the corresponding female terminal 10 is accommodated, and each male terminal 110 is further inserted into the counterpart terminal connecting part 11 of the female terminal 10.

When the connector 1 reaches the fitting completion position with the counterpart connector 100, as illustrated in FIG. 6, the female terminal 10 in each terminal accommodating chamber 31 and the corresponding male terminal 110 are respectively connected, and the connector 1 and the counterpart connector 100 are locked in the fitting completion state by the fitting lock arm 50 and the locking protrusion 143.

Next, with reference to FIGS. 8A and 8B and 9, a case where the male terminal 110 is not damaged even when the connector 1 is fitted into the counterpart connector 100 in an irregular fitting posture.

FIG. 8A is a view illustrating a state where the terminal receiving portion 30 of the connector 1 hits against the fitting rib 142 of the counterpart connector 100, and FIG. 8B illustrates a state where fitting between the connector and the counterpart connector 100 progresses up to a position deeper than the detection position of the fitting rib 142.

FIG. 9 is an enlarged view of the periphery of the male terminal release hole 33 of FIG. 8B.

When the fitting operation is performed in an irregular fitting posture of the connector 1 and the counterpart connector 100, while the terminal accommodating part 30 of the connector 1 is being fitted into the cylindrical main body portion 141 of the counterpart connector 100, as illustrated in FIG. 8A, the end portion of the terminal accommodating part 30 of the connector 1 hits against the fitting rib 142 of the counterpart connector 100.

In this state, when excessive force of pushing the terminal accommodating part 30 inward of the cylindrical main body portion 141 is applied to the connector 1, the cylindrical main body portion 141 is deformed to push the interior of the cylinder by the end portion of the terminal accommodating part 30, and as illustrated in FIG. 8B, the terminal accommodating part 30 enters inward from the front end of the fitting rib 142.

As described above, when the fitting operation is performed in the irregular fitting posture of the connector 1 and the counterpart connector 100 and fitting between the connector 1 and the counterpart connector 100 progresses up to a position deeper than the detection position by the fitting rib 142 of the counterpart connector 100, as illustrated in FIG. 8B and FIG. 9, each male terminal 110 enters the male terminal release hole 33.

Therefore, each male terminal 110 is prevented from colliding with the wall surface of the terminal accommodating part 30 and being damaged.

In the connector 1 according to the embodiment of the invention, even when the connector is fitted into the counterpart connector 100 in an irregular fitting posture, since the molding through hole of the elastic locking piece 32 for locking the female terminal 10 in the terminal accommodating chamber 31 is formed as a male terminal release hole

33 at a position where the male terminal 110 enters and releases, the male terminal 110 can be prevented from hitting against the wall of the connector 1. In addition, since as the male terminal release hole 33, the molding through hole of the elastic locking piece 32 is utilized, an increase in size is not caused. Accordingly, while achieving miniaturization, it is possible to prevent the male terminal 110 of the counterpart connector 100 from being damaged, even when the fitting operation is performed in the irregular fitting posture due to excessive force.

Although the invention made by the present inventor has been specifically described based on the embodiment of the invention as above, the present invention is not limited to the above-described embodiment of the invention, and various modifications can be made within the scope that does not depart from the gist thereof.

What is claimed is:

1. A connector comprising:

a connector housing, wherein the connector housing includes:

a terminal accommodating chamber in which a female terminal is to be accommodated;

an elastic locking piece configured to lock the female terminal accommodated in the terminal accommodating chamber; and a wall surface, wherein the wall surface includes:

a male terminal insertion hole into which a male terminal of a counterpart connector is to be inserted so as to be connected to the female terminal, when a fitting operation between the connector and the counterpart connector is performed in a regular fitting posture; and a male terminal release hole into which the male terminal is to enter, when the fitting operation is performed in an irregular fitting posture, and wherein the male terminal release hole forms a space which is continuous from the wall surface to the elastic locking piece.

2. The connector according to claim 1, wherein the male terminal release hole is formed as a molding through hole for molding the elastic locking piece.

* * * * *